US005169445A

United States Patent [19]

Yonehara et al.

[11] Patent Number: 5,169,445

[45] Date of Patent: Dec. 8, 1992

[54] FLOOR COATING AGENT APPLYING MACHINE AND ITS APPLYING UNIT CONSTRUCTION

[75] Inventors: Takashi Yonehara; Yasuo Yata; Yasuhiko Matsumoto, all of Osaka, Japan

[73] Assignee: Penguin Wax Co., Ltd., Osaka, Japan

[21] Appl. No.: 780,425

[22] Filed: Oct. 22, 1991

Related U.S. Application Data

[63] Continuation of Ser. No. 548,297, Jul. 5, 1990.

[30] Foreign Application Priority Data

Sep. 16, 1989 [JP] Japan ..... 1-240353
Sep. 16, 1989 [JP] Japan ..... 1-240354

[51] Int. Cl.[5] ..... B05C 9/14; B05C 11/06

[52] U.S. Cl. ..... 118/63; 15/50.2; 15/320; 118/108; 118/109; 118/207; 118/256

[58] Field of Search ..... 118/62, 63, 108, 109, 118/120, 207, 256, 266, 305; 15/98, 50.1, 50.2, 320-322

[56] References Cited

U.S. PATENT DOCUMENTS 2,447,172 8/1948 Gordon ..... 15/50.1
3,453,988 7/1969 Trent et al. ..... 118/120 X
3,655,444 4/1972 Young ..... 15/98 X
3,657,759 4/1972 Sawyer ..... 15/98
3,972,088 8/1976 Thomas ..... 15/98 X
4,471,713 9/1984 Cote et al. ..... 118/305 X
4,595,420 6/1986 Williams, III et al. ..... 15/320 X
4,732,109 3/1988 Selby ..... 118/305 X
4,910,824 3/1990 Nagayama et al. ..... 15/98

FOREIGN PATENT DOCUMENTS 1101709 3/1961 Fed. Rep. of Germany .
63-315169 12/1988 Japan .

*Primary Examiner*—Richard L. Chiesa
*Attorney, Agent, or Firm*—Gifford, Groh, Sprinkle, Patmore and Anderson

[57] ABSTRACT

A floor coating agent applying machine having a movable machine body, an applying member attached to the movable machine body for applying a floor coating agent onto a floor surface. The applying member includes a plurality of elastic rods vertically suspended from the movable machine body, with the rods being arranged in a loop-like formation as viewed from above the movable machine body, an eccentric rotary cam drivably attached to the movable machine body and rotatable on a vertical axis positioned inside the loop of the elastic rods and a circular recess vertically slidably fitted about the eccentric rotary cam so as to cause a rotational force of the cam to elastically deform the elastic rods thus producing vertical vibration of the applying member.

6 Claims, 4 Drawing Sheets

FLOOR COATING AGENT APPLYING MACHINE AND ITS APPLYING UNIT CONSTRUCTION

This is a continuation of copending application Ser. No. 07/548,297 filed on Jul. 5, 1990, now abandoned.

BACKGROUND OF THE INVENTION

1. Field of the Invention

The present invention relates to a floor coating agent applying machine and its applying unit construction.

2. Description of the Related Art

A typical floor coating agent applying machine is known from e.g. a Japanese laid-open patent gazette No. 63-315169. In this machine, a drive mechanism is provided for vertically vibrating an agent applying member so that the vibration can effectively apply and spread the agent uniformly over a floor surface thus forming as thin a coating layer as possible on the floor surface.

The above machine creates a problem of the vertical vibration generating air bubbles in the agent applied to the floor surface. If the coating as containing air bubbles therein is let to dry, there occurs nebula, roughness or irregularity in the finish surface.

Then, the primary object of the present invention is to overcome the above-described problem of the prior art by providing an improved floor coating agent applying machine and its applying unit construction which can effectively restrict generation of air bubbles in the agent layer and which can uniformly apply the agent for superior finish.

SUMMARY OF THE INVENTION

For accomplishing the above-noted object, a floor coating agent applying machine, relating to the present invention, comprises: a movable machine body; an applying member attached to the movable machine body for applying a floor coating agent onto a floor surface; and an applying-member driving mechanism for causing the coating agent applying member to vertically vibrate and laterally oscillate along a floor surface to be treated.

Functions and effects of the above machine will now be described.

The applying-member driving mechanism causes the applying member to vertically vibrate and laterally oscillate along the floor surface, such that the oscillating motion of the applying member not only helps efficient application of the coating agent by the vertical vibrating motion of the applying member but also prevents mechanical resonance of the agent due to the vertical vibration of the member. Accordingly, the applying member, by its vertical vibration and oscillation motion, can apply the floor coating agent efficiently and uniformly over the floor surface with generation of air bubbles in the applied agent being effectively prevented. Consequently, the agent will be applied so thinly and uniformly over the entire floor surface that the applied agent can be dried speedily and the finish condition will be superior.

According to one preferred embodiment of the present invention, a floor coating agent applying machine comprises: a movable machine body; an applying member attached to the movable machine body for applying a floor coating agent onto a floor surface. The applying member includes; a plurality of elastic rods vertically suspended from the movable machine body, with the rods being arranged in a loop formation as viewed from above the movable machine body, an eccentric rotary cam drivably attached to the movable machine body and rotatable on a vertical axis positioned inside the loop of the elastic rods, and a circular recess vertically slidably fitted about the eccentric rotary cam so as to cause a rotational force of the cam to elastically deform the elastic rods thus producing vertical vibration of the applying member.

With the above-described construction in operation, as the eccentric rotary cam being rotated, this cam rotation is transmitted through the circular recess to the applying member. Also, because of the eccentricity of the cam, the applying member is horizontally oscillated relative to the floor surface with a radius corresponding to the eccentricity of the rotary cam, while elastically deforming the elastic rods one after another. Accordingly, as the oscillating motion of the applying member proceeds, the elastic rods repeatedly contract and expand thereby to lift up and down the applying member. Further, with these movements of the elastic rods, the applying member moves up and down with respect to the machine body with the circular recess vertically sliding relative to the eccentric rotary cam.

Then, as the applying member effects vertical vibration and horizontal oscillation simultaneously, the floor coating agent can be efficiently and uniformly applied over the floor surface with generation of air bubbles in the applied agent being effectively prevented.

As described above, according to the floor coating agent applying machine of the present invention, the simultaneous vertical vibration and horizontal oscillation of the applying member achieves uniform and thin coating agent layer. Thus, compared with the conventional applying machine, the machine of the present invention can provide superior, i.e. thin and smooth coating surface and also achieve improvemnt of efficiency by quickening of subsequent drying operation by thinness of the coating layer.

Moreover, the driving mechanism for providing simultaneous vertical vibration and horizontal oscillation of the applying member has a very simple construction consisting mainly of a plurality of elastic rods suspended vertically from the machine body and an eccentric rotary cam. This driving mechanism construction, as compared with the conventional driving construction adaped for vertically vibrating the entire applying unit which supports the applying member and oscillates the same as well, requires considerably fewer number of machine elements and therefore is very simple, compact and economical.

Further and other objects, features and effects of the invention will become more apparent from the following more detailed description of the embodiments of the invention with reference to the accompanying drawings.

BRIEF DESCRIPTION OF THE DRAWINGS

Accompanying drawings illustrate preferred embodiments of a floor coating agent applying machine relating to the present invention; in which.

DESCRIPTION OF THE PREFERRED EMBODIMENTS

Preferred embodiments of a floor coating agent applying machine relating to the present invention will now be particularly described with reference to the accompanying drawings.

Figure 1:
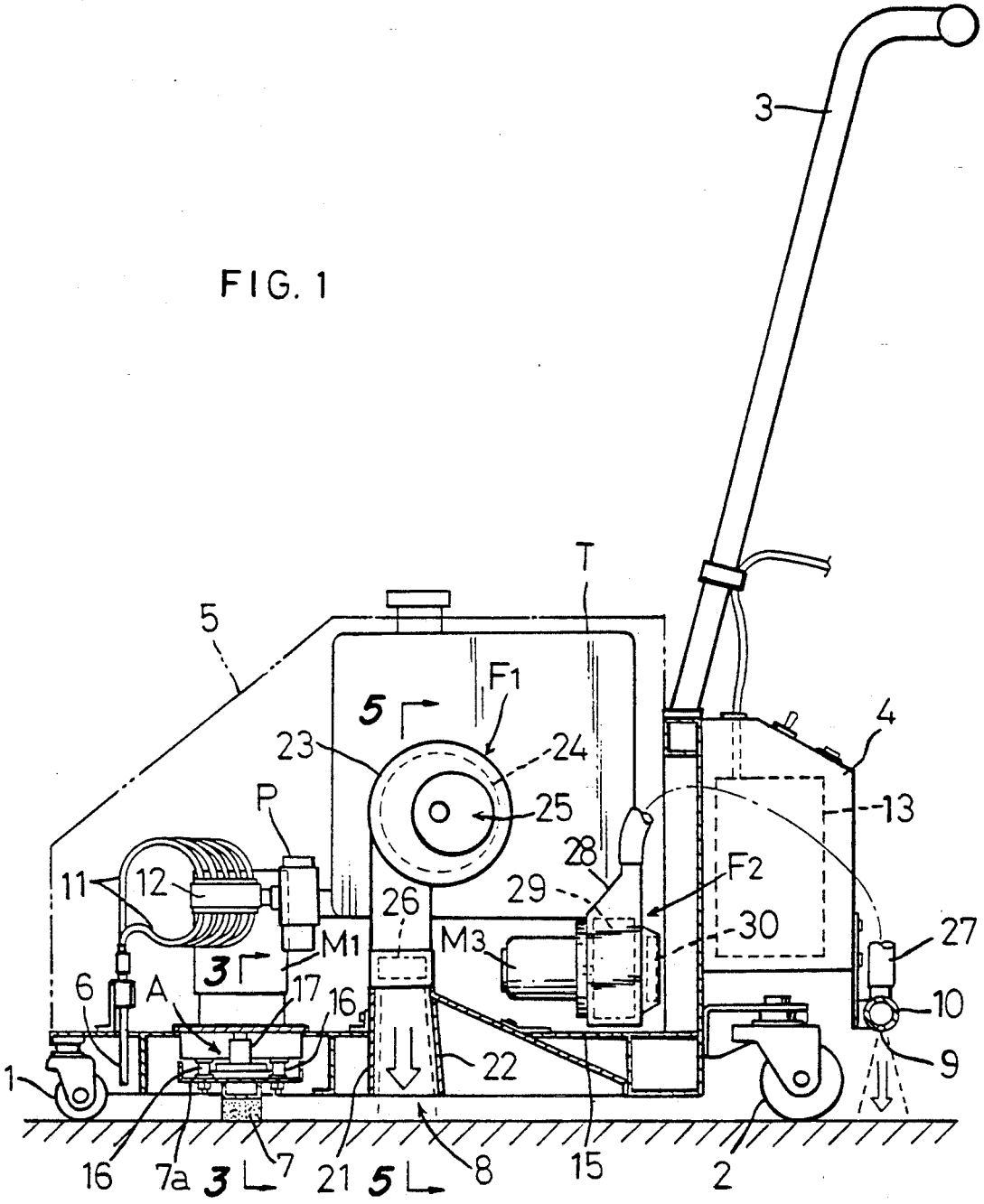
FIG. 1 is a side view showing an entire applying machine.

As shown in FIG. 1, a floor coating agent applying machine of the invention is constructed as a walking-operator type including front wheels 1 and rear weels 2 both of free rotation type, a steering handle 3, a housing 5 for covering the movable machine body, a plurality of coating agent feed nozzles 6 all of which are attached to a bottom of the machine body and disposed side by side in the transverse direction of the machine body, an agent applying member 7 formed of elastic material, a first air feed opening 8 and an air feed pipe 10 having a plurality of second air feed openings 9 aligned along the transverse direction of the machine body. The housing 5 accomodates therein coating agent tank T, a pair of hot-air feed fans F1, F1 disposed side by side along the transverse direction, a further air feed fan F2 for feeding normal temperature air and so on. Further, a control box 4 is attached to the movable machine body.

In operation, a coating agent solution of thermoplastic resin material is charged to and reserved at the tank T. Then, as the machine body is propelled by a walking operator on a floor surface formed e.g. of stone, wood, concrete or other artificial material so as to apply the coating agent solution on the floor surface.

More particularly, the coating agent feed nozzles 6 are disposed with distance from the floor surface and are connected with the tank T through agent feed tubes 11, a distributor 12 and an electric pump P. This pump P is controlled and driven by means of a controller 13 housed at the control box 4 for withdrawing the agent solution from the tank T and feeding the solution to the distributor 12, so that a fixed and substantially equal amount of the solution is supplied from the tank T to the respective feed nozzles 6 to be consequently applied therethrough to the floor surface therethrough. The amount of the solution is predetermined by the displacement of the pump P and also by the number of the nozzles 6.

Figure 2:
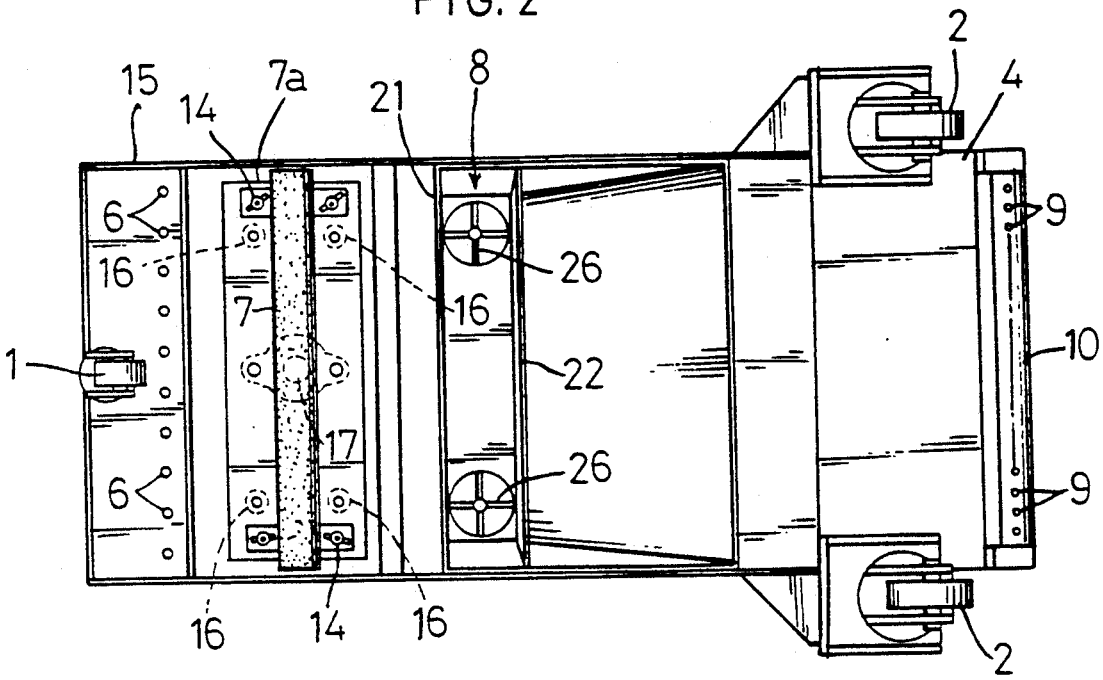
FIG. 2 is a bottom view of the applying machine.

The applying member 7 is disposed rearwardly of the feed nozzles 6 with respect to the advancing direction of the machine body. Also, as shown in a plane view of FIG. 2, the applying member 7 is attached to an attaching portion 7a through a plurality of attaching bolts 14, for the purpose of facilitating cleaning and exchange operation of the applying member 7 if and when necessary. Further, between the attaching portion 7a and a machine body frame 15 formed of plate metal, there are provided four rubber rods 16 as elastic rods oriented vertically relative to the machine body and together forming an angular loop as seen in the plane view of FIG. 2. Accordingly, the applyig member 7 is attached to the machine body frame 15 while being suspended therefrom through the elastic rubber rods 16. Incidentally, for obtaining proper contact pressure between the applying member 7 and a floor surface to be treated, the height of the machine body frame 15 as measured from the floor surface and the distance between the frame 15 and the applying member 7 are properly predetermined.

Figure 3:
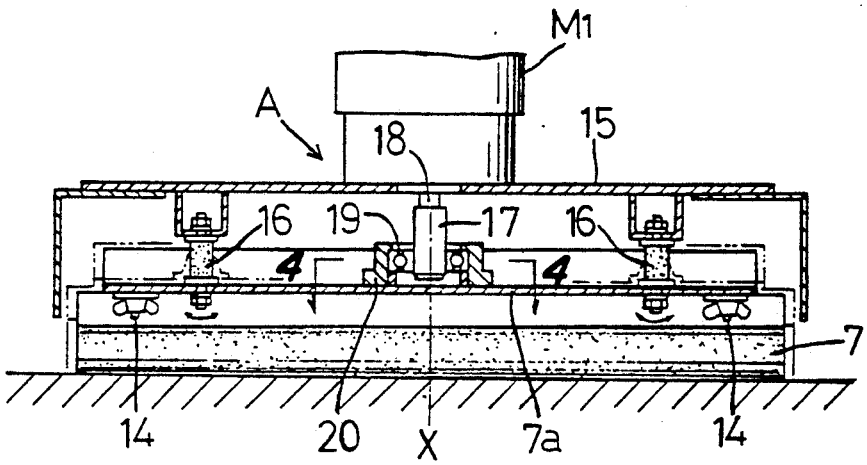
FIG. 3 is a cross section taken along a line 3—3 of FIG. 1.

As shown in FIG. 3, for laterally oscillating and vertically vibrating the above-described applying member 7, there is provided an applying member driving mechanism A. This mechanism A includes a rotary cam 17 disposed between the attaching portion 7a and the machine body frame 15 and an electric motor M2 fixedly mounted on the frame 15. More particularly, the rotary cam 17 is fitted on an output shaft 18 of the electric motor M1, so that the cam 17 is rotated together with the shaft 18 about a vertical axis X thereof at a velocity of 3,000 rpm. The rotation and operation of the motor M1 is controlled by the controller 13. Further, the rotary cam 17 is constructed as an eccentric rotary cam having two axes, with one axis being positioned at a center of a cylindrical outer periphery of the cam and the other axis being the rotational axis corresponding to the aforementioned vertical axis X and horizontally displaced from the first-mentioned axis. Also, in this particular embodiment, the vertical axis X is positioned at the center of the angular loop formed by the four rubber rods 16.

Figure 4:
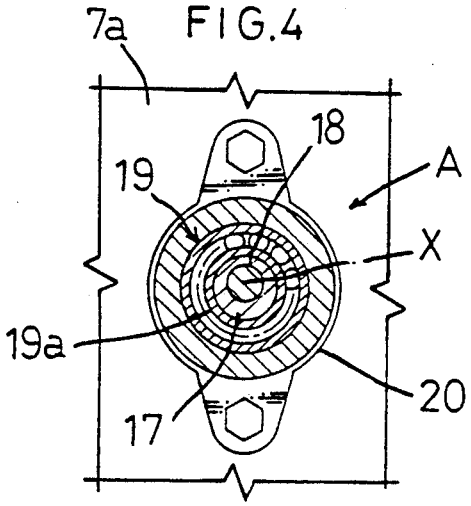
FIG. 4 is a partially cutaway plane view showing a rotary cam and its periphery.

Moreover, as shown in FIG. 4, a bearing 19 having an inner ring 19a acting as a circular recess surrounding the rotary cam 17 is fixed through a bearing holder 20 to an upper face of the attaching portion 7a. Then, in operation, as the rotary cam 17 is driven to rotate, this rotational force of the cam 17 is transmitted through the bearing 19 to laterally oscillate the attaching portion 7a about the vertical axis X within the radial eccentricity of the cam 17 while elastically deforming the rubber rods 16, whereby the applying member 7 effects an oscillating motion relative to the floor surface. At the same time, because the oscillating motion of the attaching portion 7a causes elastic contraction and expansion of the rubber rods 16 repeatedly and also because the inner ring 19a is vertically slidable with respect to the rotary cam 17, the attaching portion 7a effects a vertical motion which produces vertical vibration of the applying member 7.

That is to say, because of the driving force of the electric motor M1, the eccentricity of the rotary cam 17 and also of the elastic deformation of the rubber rods 16, the applying member 7 laterally oscillates and vertically vibrates along the floor surface, so that the coating agent solution fed through the feed nozzles 6 can be applied onto the floor surface uniformly and thinnly.

Figure 5:
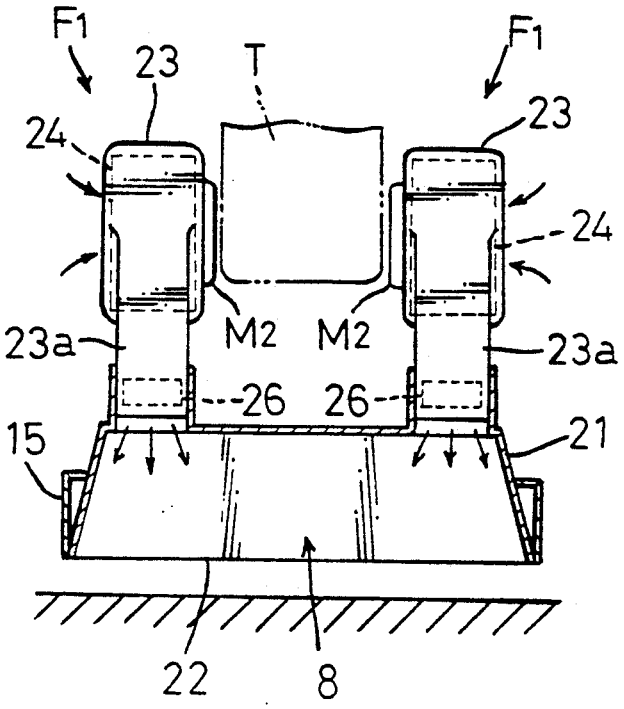
FIG. 5 is a cross section taken along a line 5—5 of FIG. 1.

The first air feed opening 8 includes an orifice type air guide member 21 attached to the machine body frame 15 with a downward orientation relative thereto and rearwardly of the applying member 7 and an air guide plate 22 attached to an inner face of the guide member 21. As shown in FIG. 5, the pair of hot air feed fans F1, F1 are respectively driven by further electric motors M2 attached to fan casings 23 which are mounted on an upper plate portion of the air guide member 21. The electric motors M2 are controlled by the controller 13. In operation, as the motors M2 are driven by the controller 13, rotary fan bodies 24 are driven thereby to introduce ambient air through air intake openings 25 into the fan casings 23. The introduced air is caused to advance through air exhaust cylinders 23a incorporating heater cables 26, whereby the air is heated up to about 60 degrees Celsius by the cables 26 and this hot air is fed to the interior of the air guide member 21. In this way, the first air feed opening 8 feeds the heated air flow from the fans F1, F1 onto the floor surface coated with the agent solution applied by the applying member 7. That is to say, after the passage of the applying member 7 and when the presence of this member 7 no longer interfers with evaporation of water content in the applied agent solution, the hot air is fed to render the surface plasticized and glossy while effectively and speedily drying the applied solution.

The air feed pipe 10 is attached to a substantially rear end position of the machine body, i.e. to a rear face of the control box 4, with a predetermined downward orientation with respect to the machine body; hence, all of the second air feed openings 9 of the pipe 10 are disposed rearwardly of the first air feed opening 8. Also, the air feed pipe 10 is connected through an air tube 27 to the further fan F2 for feeding the normal temperature air flow. This fan F2 is operatively connected with a further electric motor M3 which is fixedly attached to a fan casing 28 and is controlled by the controller 13. In operation, as the motor M3 is driven by the controller 13 to drive the fan F3, a rotary fan body 29 is driven by the motor to introduce ambience air through an air filter 30 into the air tube 27, so that the second air feed openings 9 feed therethrough the normal-temperature air flow to the floor surface after the hot-air treatment by the first air feed opening 8. This normal-temperature air blowing operation is for forcibly drying any water content remaining after the hot-air blowing operation, thereby further quickening the entire machine operation.

Figure 6:
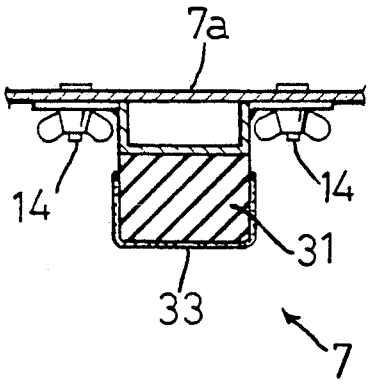
FIG. 6 is a cross section of an applying member.

As shown in FIG. 6, the applying member 7 comprises a combination of an elastic rubber element 31 and a sheet element 33 for forming an agent applying face. This sheet element 33 is formed of such material as woven material, non-woven material, felt, paper, leather or the like. That is, the element 31 for supporting the sheet element 33 is formed of rubber material which is relatively soft and elastic for conveniently preventing generation of air bubbles in the applied coating and also for providing cushion effect for the sheet element 33. Whereas, the sheet element 33 is formed of one of the abovementioned material which is suitable for retaining the coating agent solution therein.

Figure 7:
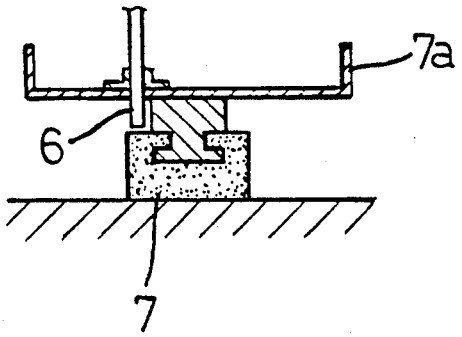
FIG. 7 is a partially cutaway side view of an applying member relating to a further embodiment of the present invention.

FIG. 7 shows an alternate construction of the applying unit. In this construction, the applying member 7 is formed of a water-retentive material such as sponge. Further, the coating agent feed nozzles 6 are adapted to first feed the agent solution to this applying member 7. That is, the coating agent solution from the tank T is caused to be once retained in the applying member 7 and then applied onto the floor surface.

Figure 8:
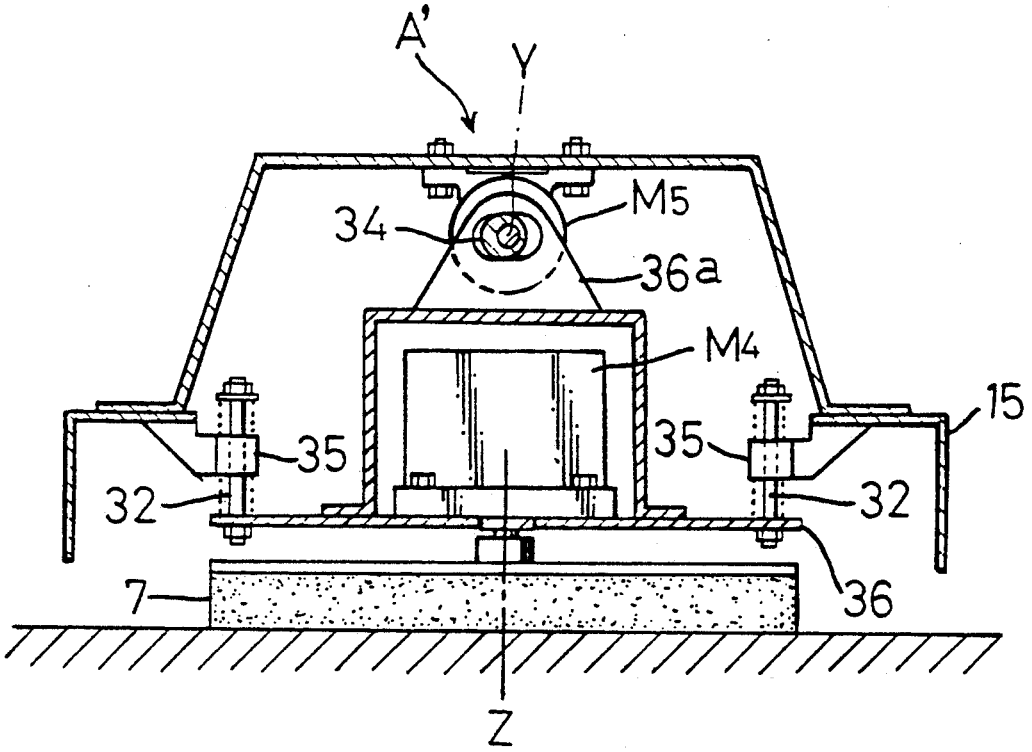
FIG. 8 is a partially cutaway front view showing an applying-member driving mechanism relating to a still further embodiment of the invention.

FIG. 8 shows an alternate construction of the applying member driving mechanism which is denoted by a reference mark A'. In this alternate construction, an applying member support member 36, which mounts the applying member 7 through a first electric motor M4, is vertically movably attached to a guide portion 35 of the machine body frame 15. Further, an eccentric rotary cam 34 fitted within an oval slot defined in a control arm portion **36*a* of the applying member support member 36 is attached to the machine body frame 15 through a second electric motor M5, so that the second electric motor M5 rotates the eccentric rotary cam 34 about a horizontal axis Y thereby vertically moving the applying member support member 36 along a guide slot of the guide portion 35. Also, the first electric motor M4 drives the applying member 7 to oscillate about a vertical axis Z. That is, as the second electric motor M5 vertically oscillates the applying member 7, the first electric motor M4 and also the applying-member support member 36, the applying member 7** vertically vibrates and laterally oscillates along the floor surface.

Figure 9:
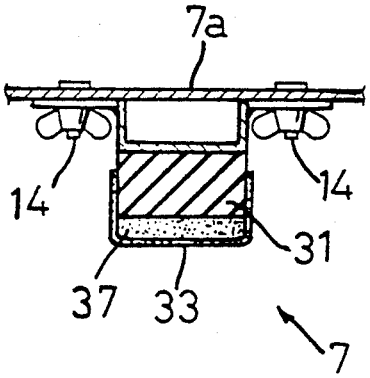
FIG. 9 is a cross section of an applying member relating to a further embodiment of the invention.

FIG. 9 shows an alternate construction of the applying member 7. The applying member 7 of this construction includes a rubber element assembly 31, a water-retentive sponge 37 and an applying-face forming sheet element 33 formed of such material as woven material, non-woven material, felt, paper, leather or the like. With this construction, even if the rubber element assembly 31 has relatively low elasticity, the entire elasticity of the applying member 7 is appropriately increased by that of the sponge 37. Also, the sponge 37 and the sheet 33 together provide the wetting power needed for retaining a certain amount of the coating agent solution. Furthermore, the sheet 33 acts to restrict generation of air bubbles due to air intake through elastic contraction and expansion of the sponge 37.

In the foregoing embodiment, the applying unit construction includes four rubber rods 16. Instead, less or more than four of the rubber rods 16 can be employed. Further alternately, coil springs or cylindrical springs can be used instead of the rubber rods 16.

In the foregoing embodiment, the rotational axis X of the rotary cam 17 is positioned at the center of the loop formed by the elastic rods 16. Instead, the axis X can be positioned off the center within the loop.

In place of the inner ring **19*a*, it is conceivable to form a circular through hole in the attaching portion 17*a* or to attach a cylindrical member to the portion 17*a* so that the attaching portion 17*a* outwardly engages the rotary cam 17 directly or through the circular through hole for vertically sliding relative to the cam 17. For this reason, the inner ring 19*a* is generically referred to as a circular recess 17*a* outwardly engaging the rotary cam 17**.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A floor coating agent applying machine comprising:

a movable machine body;

an applying member attached to said movable machine body for applying a floor coating agent onto a floor surface to be treated;

an applying member driving mechanism attached to said machine body by elastic rod means, said applying member driving mechanism causing said applying member to vertically vibrate and laterally oscillate along the floor surface; and means for drying said coating agent mounted to said applying machine, said means for drying comprising a first drying means and a second drying means, said first drying means being positioned behind said applying member and directing hot air toward said floor surface, said second drying means directing air of ambient temperature toward said floor surface subsequent to said first drying means.

2. The floor coating agent applying machine as claimed in claim 1, wherein said applying member includes an elastic element and an applying-face forming sheet surrounding said elastic element.

3. The floor coating agent applying machine as claimed in claim 2, wherein said applying member further includes a water-retentive element interposed between said elastic element and said applying-face forming sheet.

4. The floor coating agent applying machine as claimed in claim 1, wherein said applying member is formed of water-retentive material.

5. A floor coating agent applying machine comprising:

a movable machine body;

an applying member attached to said movable machine body for applying a floor coating agent onto a floor surface;

said applying member including;

a plurality of elastic rods vertically suspended from the movable machine body, with said rods being arranged in a loop formation as viewed from above the movable machine body, an eccentric rotary cam drivably attached to the movable machine body and rotatable on a vertical axis positioned inside said loop of the elastic rods, and a circular recess vertically slidably fitted about said eccentric rotary cam so as to cause a rotational force of the cam to elastically deform said elastic rods thus producing vertical vibration of said applying member.

6. A floor coating agent applying machine as claimed in claim 5, wherein said rods comprise four rubber rods forming said loop.

* * * * *